US009586253B1

(12) United States Patent
Jensen et al.

(10) Patent No.: US 9,586,253 B1
(45) Date of Patent: Mar. 7, 2017

(54) REDUCING NIPPLE FOR A FIRE SPRINKLER SYSTEM, AND MANUFACTURING PROCESS THEREFOR

(75) Inventors: Erik T. Jensen, Wayne, PA (US); Theodore R. Jensen, Pottstown, PA (US)

(73) Assignee: AEGIS TECHNOLOGIES, INC., Wayne, PA (US)

( * ) Notice: Subject to any disclaimer, the term of this patent is extended or adjusted under 35 U.S.C. 154(b) by 1205 days.

(21) Appl. No.: 13/422,928

(22) Filed: Mar. 16, 2012

Related U.S. Application Data

(60) Provisional application No. 61/453,479, filed on Mar. 16, 2011.

(51) Int. Cl.
*B21D 39/04* (2006.01)
*H01R 43/048* (2006.01)

(52) U.S. Cl.
CPC ..... *B21D 39/048* (2013.01); *H01R 43/048* (2013.01)

(58) Field of Classification Search
CPC .. B21D 39/04; B21D 39/048; H01R 43/0428; H01R 43/0425; H01R 43/048; H01R 43/0482; B21C 37/15; B21C 37/155; B21C 37/16; B21C 37/20; B21C 37/0803
USPC ..... 72/370.23–370.26, 467, 468
See application file for complete search history.

(56) References Cited

U.S. PATENT DOCUMENTS

2008/0302164 A1* 12/2008 Bauer ..... B21D 41/02 72/370.1

* cited by examiner

*Primary Examiner* — Debra Sullivan
(74) *Attorney, Agent, or Firm* — John F. A. Earley, III; Frank J. Bonini, Jr.; Harding, Earley, Follmer & Frailey, P.C.

(57) ABSTRACT

A method for producing a reducing nipple and a reducing nipple that may be used in place of the conventional pipe nipple/threaded reducer assembly typically used today to connect a branch or run pipe extending horizontally parallel to and positioned above a ceiling or in an open ceiling to a sprinkler head, where the nipple has an outlet end portion with an outlet and a wrenching portion, the method of producing a reducing nipple involving engaging a pipe section with a crimping die under the application of a crimping force.

19 Claims, 3 Drawing Sheets

REDUCING NIPPLE FOR A FIRE SPRINKLER SYSTEM, AND MANUFACTURING PROCESS THEREFOR

CROSS REFERENCE TO RELATED APPLICATION

This application is based on and claims priority to and benefit of U.S. Provisional Application No. 61/453,479, filed on Mar. 16, 2011, the complete disclosure of which is incorporated herein by reference in its entirety.

BACKGROUND OF THE INVENTION

1. Field of the Invention

This invention relates to fire sprinkler apparatus for use with a drop ceiling of suspended tile or sheetrock, and more particularly concerns a reducing nipple that may be used in place of the conventional assembly typically used today to connect a branch or run pipe extending horizontally parallel to and positioned above a drop ceiling to a sprinkler head mounted beneath the drop ceiling, said conventional assembly comprising a pipe nipple and a threaded reducer (threaded reducing coupling).

2. Description of the Prior Art

The typical apparatus presently employed by fire sprinkler contractors includes a drop nipple (e.g., a 1 inch pipe nipple) which delivers water from a branch pipe to a sprinkler head that is arranged to fit flush against the underside of a suspended ceiling tile or sheetrock ceiling. The drop nipple is threaded on both ends, with one end screwed into a threaded outlet connection on the branch pipe which runs parallel to the unfinished drop ceiling and is positioned above it. The sprinkler head is mounted on the bottom end of the drop nipple and is arranged to fit flush against the underside of the suspended ceiling tile. This arrangement is labor intensive. The sprinkler installer must make two threaded connections to the drop nipple, one at the top portion of the drop nipple and one at the bottom portion of the drop nipple before the suspended ceiling is installed. Following installation of the suspended tile ceiling by the ceiling installer, the sprinkler installer must return to cut the drop nipple to allow the sprinkler head to fit flush against the underside of the ceiling tiles. Also, many parts are required to complete the typical assembly: i.e., the drop nipple threaded at top and bottom portions; a threaded reducing coupling for reducing the one inch inside diameter of the drop nipple to the one half inch or three quarter inch inside diameter thread on the sprinkler head; a two-piece escutcheon assembly which is mounted on the reducing coupling and which receives the sprinkler head permits the second part of the escutcheon to receive a flanged decorative cover to cover the hole in the ceiling tile, and, of course, the sprinkler head itself.

An assembly comprising a pipe nipple and a threaded reducer (threaded reducing coupling) (such an assembly hereinafter being referred to as a "pipe nipple/threaded reducer assembly" or a "reducing nipple assembly"), such as a 1 inch×½ inch or ¾ inch reducing nipple assembly, is widely used and is considered the standard in fire protection system installations.

Attempts to replace the pipe nipple/threaded reducer assembly in the marketplace have been made. For example, integrated reducing nipples, such as those sold under the trademark "Merit Longneck" and disclosed in Jensen U.S. Pat. No. 6,533,041, which is incorporated herein in its entirety by reference, and integrated reducing nipples sold under the trademark "Vanderwater Fast Drop", have been introduced as an alternative to the conventional pipe nipple/threaded reducer assembly. However, such integrated reducing nipples have failed to penetrate the marketplace due to the high market price and high production and material costs of these integrated reducing nipples compared to the lower costing conventional pipe nipple/threaded reducer assembly. Prior reducing nipples also have been known to suffer from poor quality in their inner diameter constructions, in particular, where the threads are located.

SUMMARY OF THE INVENTION

It is object of the invention to provide a reducing nipple that may be used in place of the conventional pipe nipple/threaded reducer assembly typically used today to connect a branch or run pipe extending horizontally parallel to and positioned above a drop ceiling to a sprinkler head mounted beneath the drop ceiling.

It is another object of the invention to provide a reducing nipple that is cost effective to produce.

It is another object of the invention to use inexpensive material, such as, weld pipe, to construct a reducing nipple.

It is another object to construct a reducing nipple by forming wrench flats on a pipe section with a die and the application of a crimping force.

These and other objects of the invention are accomplished by our invention, which is set out below.

The advantages of the invention over the typical fire sprinkler apparatus installation include the following:

1) The invention reduces the cost of installation of the fire sprinkler apparatus (the inventive reducing nipple), Instead of the many pieces required by the typical conventional method of installation, the invention reduces the installation pieces to three pieces, the inventive reducing nipple, the sprinkler head, and the escutcheon fitting, thereby reducing the cost of raw material required for installation of the fire sprinkler apparatus.
2) The process of manufacture reduces costs through the use of the crimping method which enables inexpensive material, such as weld pipe, to be used to form the reducing nipple. According to a preferred embodiment, the nipple and reducing coupling are reduced to a single reducing nipple which may be formed through a crimping method applied to weld pipe.
3) The process of manufacture provides for improved alignment and centering of the hole or bore of the reducing nipple.

DETAILED DESCRIPTION

Figure 1:
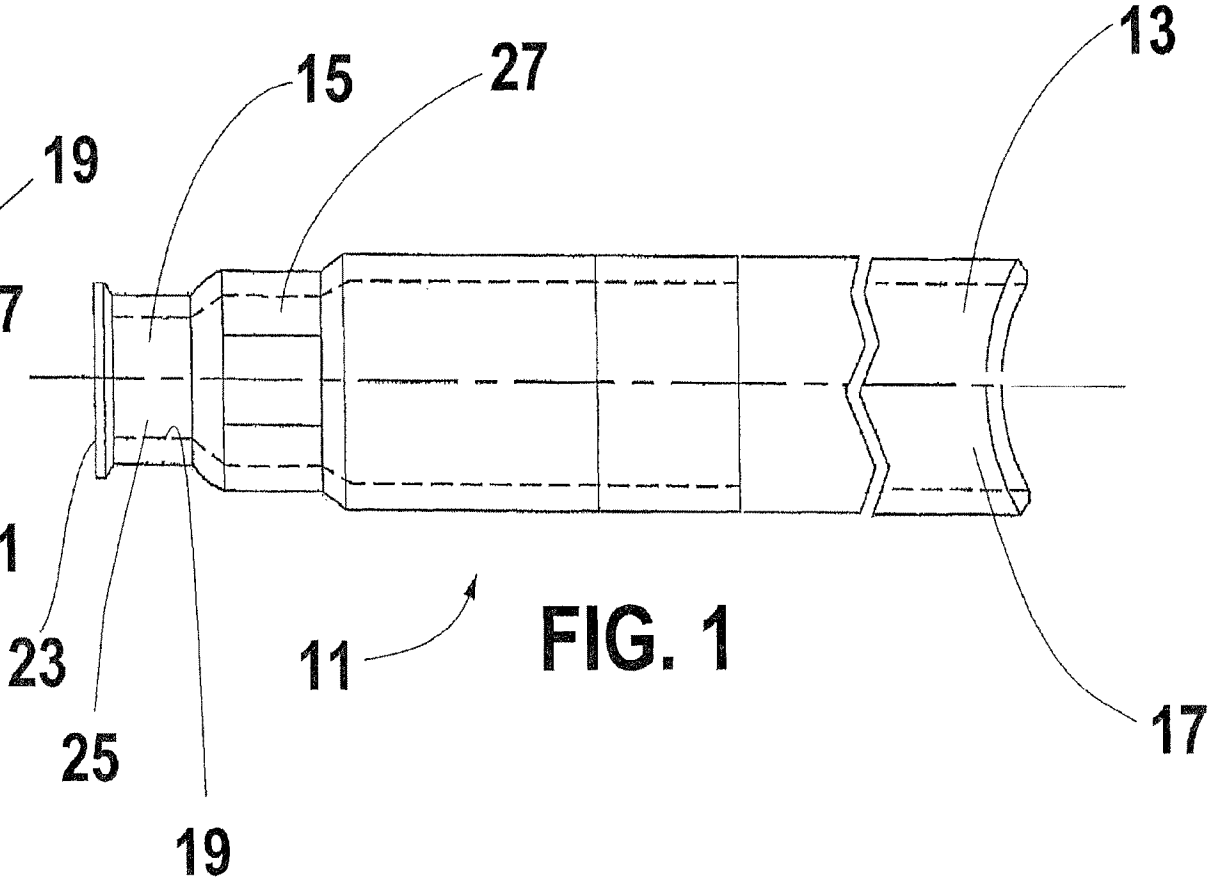
FIG. 1 is a view in elevation of our inventive reducing nipple, constructed in accordance with the invention.
Figure 2:
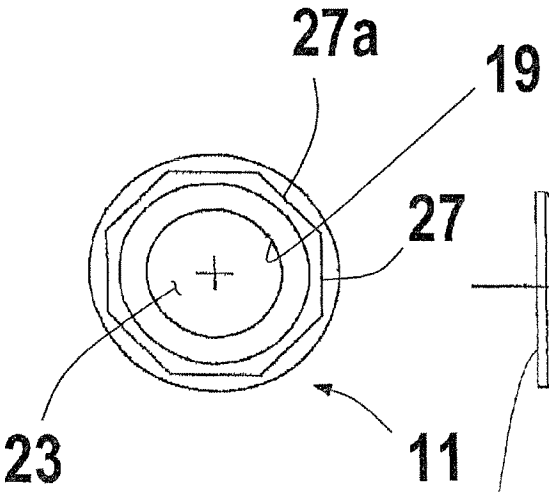
FIG. 2 is a view taken along the lines and arrows 2-2 shown in FIG. 1.

Turning to the drawings, in FIGS. 1-2, our inventive reducing nipple 11 is shown. The reducing nipple 11 has an inlet end portion 13 and an outlet end portion 15 and is made from a continuous piece of pipe, such as a continuous piece of 1" (1.315" OD (outer diameter)) steel weld pipe conforming to A53 pipe standard or the like. The reducing nipple 11 may be used in place of a conventional pipe nipple/threaded reducer assembly (such as a typical 1" pipe nipple and ½" or ¾" threaded reducer assembly) used to connect a branch or run pipe extending horizontally parallel to and positioned above a drop ceiling to a sprinkler head mounted beneath the drop ceiling, or positioned upwardly from the branch pipe in open or exposed ceiling plans or locations where there is an open or exposed ceiling portion.

Preferably, the inlet end portion 13 of the inventive reducing nipple 11 is provided with threading (a male thread, preferably a 1" male thread) on its outer surface 17 or no threading (plain—no thread) or a weld contoured inlet.

The outlet end portion 15 preferably is provided with a female threading (preferably either a ½" or ¾" female thread) along its inner surface 19.

Preferably, the length of the inventive reducing nipple 11 is in a range from about 2½" long to 37" long, and more preferably, in a range from about 4" long to 37" long.

Figure 3:
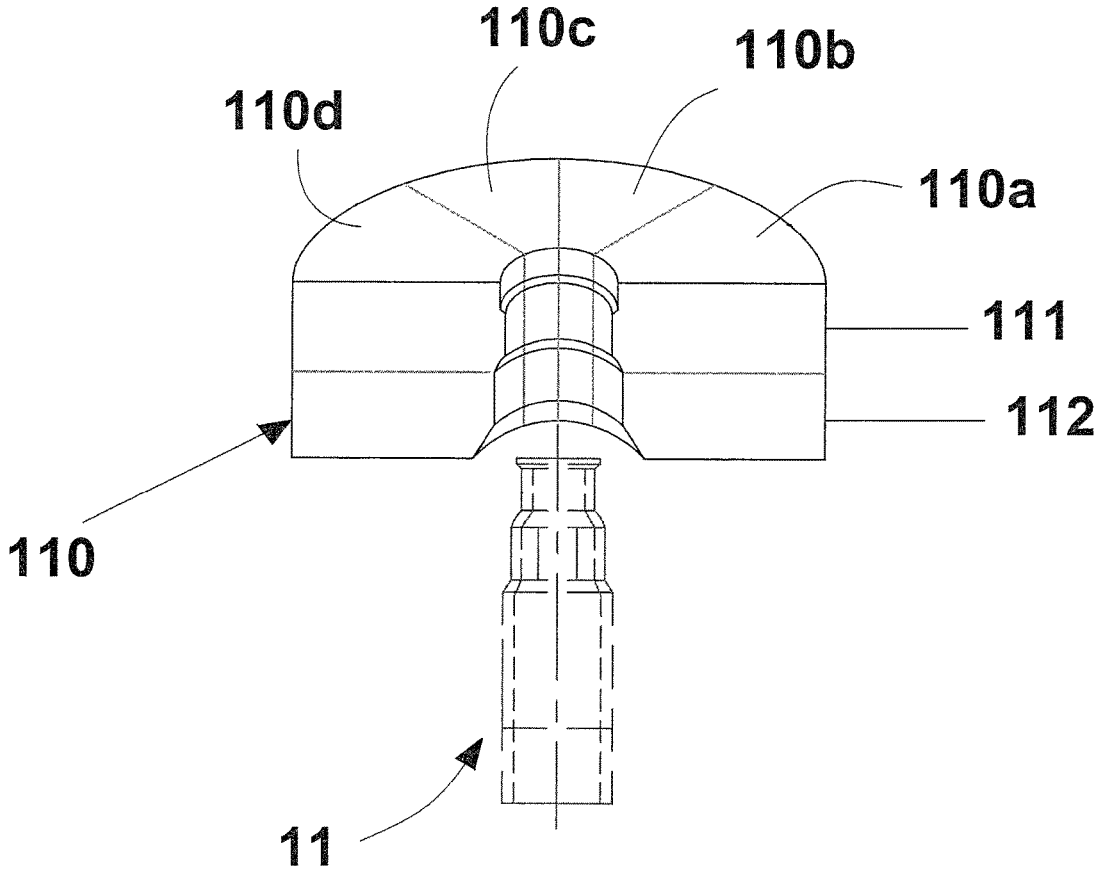
FIG. 3 is a perspective view, looking from the top front, of a die used to form the inventive reducing nipple shown in FIGS. 1-2.
Figure 6:
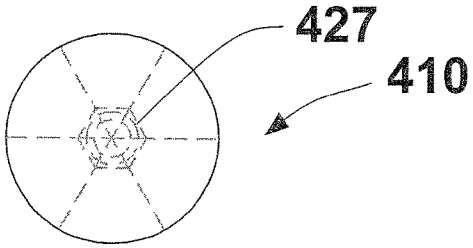

Preferably, an integral wrenching portion 27 is formed in the outlet end portion 15, preferably approximately 1 inch from the outlet 23 of the outlet end portion 15, thereby creating an area (i.e., wrenching portion 27) on the reducing nipple 11 where a wrench may be used to engage the reducing nipple 11. The wrenching portion 27 may be provided with a number of sides, such as, for example, eight-sides, as shown in FIGS. 2 and 3, and six sides as shown in FIG. 6. The number of sides is based on the die configuration used, as discussed below.

According to a preferred embodiment, as shown in FIG. 3, a die 110 is provided to form the reducing nipple 11. The die 110, which may be a crimping die, is shown in FIG. 3 having a first segment 111 and a second segment 112, the die first segment 111 setting a hole diameter of the threaded inner surface 19 of the outlet end portion 15 of the reducing nipple 11. The die 110 is shown also having a second segment 112 which forms a wrenching portion 27 on a pipe that is to be machined into a reducing nipple 11. Machining of the pipe involves crimping a pipe segment with the die 110 and applying a crimping force to produce reduced segments on the pipe which comprise the outlet end portion 15 and the wrenching portion 27.

The die first segment 111 corresponds with the contour of the outlet end portion 15 to form the first reduced segment of the pipe comprising the outlet end portion 15 when the die 110 is brought into engagement with the pipe segment and crimped with a crimping force against the pipe segment. The die 110 also includes a second segment 112 that corresponds with the contour of the wrenching portion 27 to form a second reduced segment of the pipe when the die 110 is brought into engagement with the pipe and crimped with a crimping force against the pipe.

The outlet end portion 15 of the nipple 11 has a contour that corresponds with the contour of the die first segment 111. The wrenching portion 27 of the nipple 11 has a contour that corresponds with the contour of the die second segment 112. According to preferred embodiments, the die first segment 111 may be independently adjustable from the die second segment 112 so that relative crimping pressures may be applied to the pipe segment locations engaged by the first die segment 111 and the second die segment 112. According to a preferred embodiment, in this manner, the first die segment 111 may have an adjustable travel depth (toward the pipe segment surface) that is independently adjustable relative to the die second segment 112, which may have a different depth of travel relative to the pipe surface. For example, according to a preferred embodiment, the nipple 11 may be formed by controlling the crimping pressure. According to one embodiment, the reduced segments of the nipple 11 may be formed by applying a crimping pressure to one of the first die segment 111 or second die segment 112 that is a different crimping pressure than the crimping pressure applied to the other of the first die segment 111 or second die segment 112.

The reduced second segment of the pipe, when engaged by the die 110 and a crimping force applied, preferably forms a wrenching area or portion 27 that has at least one, and preferably more, wrench flats 27*a* (FIG. 2) that allow engagement of the reducing nipple 11 with a wrench so that the nipple 11 may be rotated to secure and detach from the threads of a branch pipe (not shown), or be held relative to a sprinkler head (not shown) that may be installed on the threaded outlet portion 25 of the nipple 11 by rotatably engaging the threads of the sprinkler head (not shown) on the threaded portion 19 of the outlet end portion 25. The wrenching portion 27 facilitates installation and removal of the nipple 11 from mating parts (e.g., sprinkler head, branch or delivery pipes).

According to a preferred embodiment, the die 110 may be constructed from a plurality of die segments, such as, for example, eight-piece die segments. As shown in FIG. 3, the die 110 includes four die sections, 110*a*, 110*b*, 110*c*, 110*d*, and although not shown, a second die half (identical to the half of the die 110 shown in FIG. 3) may be provided containing four additional die sections similar to the die sections 110*a*, 110*b*, 110*c*, 110*d*, so that when the die 110 (both halves) are brought into engagement with a pipe section, and a crimping force applied, the force of the die 110 onto the pipe section forms the nipple 11 having a first reduced portion or outlet end portion 15 and a second reduced portion or wrenching portion 27.

Figure 8:
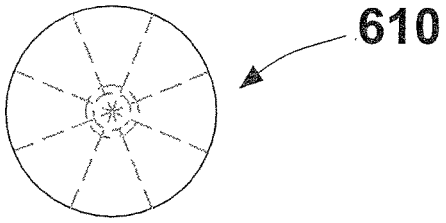
FIGS. 8-9 are end views illustrating examples of die segments showing the outlet end portion segments.
Figure 7:
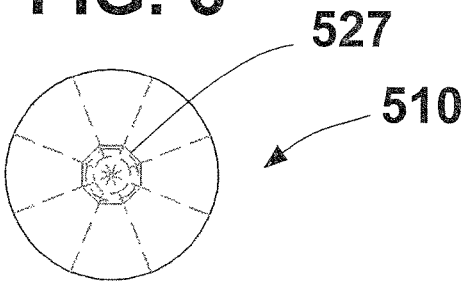

For example, the die 110 may be constructed having sections that include both a contour for the outlet end portion 15 and a contour for the wrenching portion 27. According to an alternate embodiment, a die section may comprise sections of the die first segment and die second segment 112 provided together in a section (such as a section 110*a*, 110*b*, 110*c*, 110*d*), where each section (such as a section 110*a*, 110*b*, 110*c*, 110*d*) is provided as a unit that includes a portion of the die first segment 111 and a portion of the die second segment 112. Alternately, the die sections, such as those sections 110*a*, 1106, 110*c*, 110*d*, may be provided having separate portions, wherein a first portion includes a contour corresponding to the outlet end portion 15 and second portion corresponding to the contour for the wrenching portion 27. The die 610 shown in FIG. 8 represents an exemplary embodiment of an eight section die, with a contour similar to the illustration in FIG. 3 of the die first segment 111, but depicted in an end view. FIG. 7 shows an eight flat wrenching die 510, similar to the die second segment 112 shown in FIG. 3, but depicted in an end view.

Figure 4:
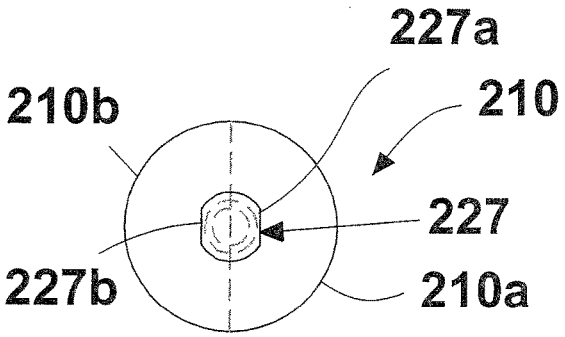
FIGS. 4-7 are end views illustrating examples of die segments showing the wrench flat segments.
Figure 5:
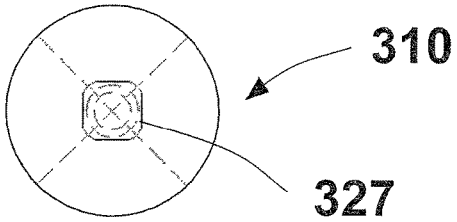

FIGS. 4 through 9 illustrate alternate embodiments of dies that may be used for forming a reducing nipple. As shown in FIG. 2, the reducing nipple 11 is illustrated having a wrenching portion 27 that is octagonal. The die 510 shown in FIG. 7 illustrates an example of a die that may be used to form an octagonal wrenching portion. FIGS. 4-7 illustrate examples of die segments showing contours of the wrench flat segments. An alternate embodiment of a die 210 is illustrated in FIG. 4, shown comprising a two-piece die 210 having a wrenching portion 227 with two flats, 227*a*, 227*b*, formed by a first die section 210*a* and a second die section 210*b*. An alternate embodiment of a die 310 is shown in FIG. 5, comprising four die sections having a wrenching portion contour 327 with four flats that may be used for forming a reducing nipple having four flats. Another alternate embodiment of a die 410 is shown in FIG. 6, comprising six die sections having a wrenching portion contour 427 with six flats that may be used to form a reducing nipple having has six flats. Another alternate embodiment of a die 510 is shown in FIG. 7, comprising eight die sections having a wrenching portion contour 527 with eight flats that may be used to forma reducing nipple having eight flats.

Figure 9:
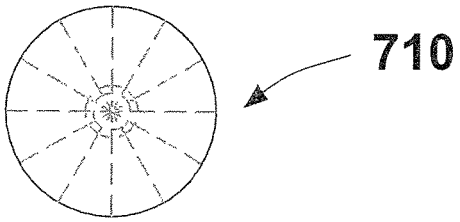

FIGS. 8 and 9 illustrate examples of die segments showing the outlet end portion segments. FIG. 8 shows an alternate embodiment of a die 610 comprising eight die sections for forming the outlet end portion 15 of a reducing nipple 11. FIG. 9 shows an alternate embodiment of a die 710 comprising twelve die sections for forming the outlet end portion of a reducing nipple. The die segments 610 and 710 of FIGS. 8 and 9, respectively, may be used with any of the wrenching die segments 112, 210, 310, 410, 510, to form a reducing nipple having the corresponding number of wrench flats of the wrench die.

Although the dies have been described as separate segments, that may include segments forming the wrenching portion and other segments forming the outlet end portion, in addition to embodiments where the dies are separate (e.g., where one section has a contour of the outlet end portion and another section has a contour for the wrenching portion), embodiments may be provided where the die sections include, in each die section, both a contour for an outlet end portion and a contour for a wrenching portion. That is, each die section 110*a*, 110*b*, 110*c*, 110*d* may be integral so that each wedge represented by a section 110*a*, 110*b*, 110*c*, 110*d* includes a segment 111 and 112.

Manufacturing Process

Our manufacturing process used to make our reducing nipple 11 is set out below. In the description of our manufacturing process set out below, a 1" pipe (having a OD (outer diameter) of 1.315 inches is used for illustrative purposes as the starting material.

The threaded outlet portion 25 and the wrenching portion 27 in the outlet end portion 15 of our reducing nipple 11 are formed by using a crimping apparatus (preferably either an eight (8) or sixteen (16) piece crimping die and machine) that reduces the OD and ID of the pipe (preferably a 1.315" OD pipe) in one step. Using the eight piece die, crimping created by the eight piece die in the threaded outlet portion 25 of the reducing nipple 11 and the crimping created by the eight piece die in the wrenching portion 27 of the reducing nipple 11 are always relative to each other, whereas by using the 16 piece die the wrenching portion 27 may be set to reduce to a nominal wrench size (1⅛" for ½" outlet and 1¼" for ¾" outlet) while the OD/ID reduction in the threaded outlet portion 25 may be adjusted to compensate for variation in the wall thickness of the pipe. This adjustment process allows us to reduce the ID (internal diameter) of the threaded portion 25 down to a size that insures that there is enough material in the ID to machine a quality pipe thread with minimal waste.

As shown in FIGS. 6 and 8, alternatively, a 14-piece crimping die may be used, where eight-pieces of the 14-piece crimping die (such as those eight pieces of the die 610 of FIG. 8) are used to form the outlet end portion of a reducing nipple, and six pieces of the 14 piece crimping die (such as those six pieces of the die 510 of FIG. 6) are used to form a wrenching portion of a reducing nipple (e.g., to form a hexagonal arrangement of wrenching flats).

The dies are designed to hold the crimped part (i.e., the threaded outlet portion 25 of the reducing nipple 11 and the wrenching portion 27 of the reducing nipple 11) throughout the machining process without interference.

Preferably, the manufacturing process comprises the following:

1) Cut pipe to order length.
2) End finish the panned 1" inlet end of blank (i.e., the pipe).
3) Mark part within 2.5" of planned outlet end of blank, if required.
4) Transfer and load blank into 8 piece die or wedge (1 or 2 pc die or wedge i.e., 8 or 16 pcs) crimping die. A 6 piece die or wedge with either 1 or 2 pc dies or wedges will do the job as well.
5) Start applying mechanical or hydraulic pressure on the crimping die to reduce the OD of the outlet end portion 15 of the reducing nipple 11. Amount of pressure and stroke is varied to obtain the proper OD and ID in threaded outlet portion 25 and OD in wrenching portion 27 in one stroke. The amount of crimp in the threaded outlet portion 25 may be varied to allow us to insure that there is enough material so we can tap a full form thread. (i.e., a quality thread).
6) Once the OD's (outer diameters) in the threaded outlet portion 25 and the wrenching portion 27 are reduced, the crimping die and machine continues to hold the pipe for secondary machining processes of end finishing, ID reaming, and ID threading in the threaded outlet portion 25. By continuing to hold the pipe in the die while secondary machining takes place, we insure that the hole center remains aligned with the end finisher, reamer, and tap. Inexpensive material such as welding pipe has a hard spot at the weld seam. This hardness makes the material move differently in areas that result in making the un-crimped or un-held length become slightly off center from the crimped end. By continuing to hold the pipe in the crimping die and machine while secondary machining takes place, we insure that the pipe does not get re-chucked differently and off center.
7) Release mechanical or hydraulic pressure so the finished part can be transferred to pneumatic pressure testing.
8) Pressure test (accept or reject).
9) Clean part of excess cutting oils.
10) Inspect and pack.

In use, the inlet end portion 13 of the reducing nipple 11 is secured to a branch pipe (e.g., is screwed into an outlet T of a branch pipe) prior to the installation of the ceiling (in the case of a non-open or exposed ceiling plan). The reducing nipple 11 preferably may be installed on the branch pipe before or after the ceiling tile is installed. For example, according to one embodiment, a first piece of a two-piece escutcheon may be placed on the nipple, and a second piece that attaches to the escutcheon first piece. According to other embodiments, the escutcheon may be installed with the sprinkler head, such as, by placing it in its location on the sprinkler head to fit flush on the ceiling. According to a preferred embodiment, the placement of the escutcheon on the sprinkler head may be done after the sprinkler head is attached to the reducing nipple 11. A sprinkler head is threaded into engagement with the female thread formed on the inner surface 19 of the outlet end portion 15 of the reducing nipple 11.

Regarding the advantages of our invention, our inventive reducing nipple 11 and method of producing a reducing nipple 11 saves the make-up labor of a typical conventional pipe nipple/threaded reducer assembly, and reduces the number of potential leak paths in a piping system.

What is claimed is:

1. A process of manufacturing a reducing nipple, comprising:

providing a pipe;

providing a die having a first segment and a second segment, said die first segment setting a hole diameter of a threaded inner surface of an outlet end portion of the nipple, and said die second segment forming a wrenching area on said pipe comprising the wrenching area of said nipple;

forming a first reduced segment of said pipe to yield said outlet end portion of said nipple by engaging said pipe with said die first segment;

forming a second reduced segment of said pipe to yield said wrenching portion by engaging said pipe with said die second segment;

wherein forming said first reduced section comprises applying an inwardly directed crimping force to compress the first segment of the die inwardly toward the pipe to crimp the pipe inwardly with the first segment of the die; and wherein forming said second reduced section comprises applying an inwardly directed crimping force to compress the second segment of the die inwardly toward the pipe to crimp the pipe inwardly with the second segment of the die.

2. The process of claim 1, wherein forming said wrenching area comprises forming an area having one or more flats.

3. The process of claim 1, wherein applying a crimping force to engage said pipe with said die first segment and said die second segment includes applying a first crimping force to said die first segment and applying a second crimping force to said die second segment.

4. The process of claim 1, including adjusting the relative crimping pressures applied on the die so that the die first segment applies a first crimping pressure to the pipe and the die second segment applies a second crimping pressure to said pipe.

5. The process of claim 1, wherein said die comprises a multi-piece die.

6. The process of claim 5, wherein said multi-piece die comprises a plurality of pieces, wherein each piece has a first portion comprising said die first segment and that corresponds with a surface of the outlet end portion and a second portion comprising said die second segment that corresponds with a surface of the wrenching portion.

7. The process of claim 5, wherein said multi-piece die comprises a plurality of pieces, including a first plurality of die pieces comprising said die first segment that corresponds with a surface of the outlet end portion, and a second plurality of die pieces comprising said die second segment that corresponds with a surface of the wrenching portion.

8. The process of claim 5, wherein said multi-piece die comprises an eight-piece die.

9. The process of claim 5, wherein said multi-piece die comprises a sixteen-piece die.

10. The process of claim 5, wherein said multi-piece die comprises a fourteen-piece die.

11. The process of claim 5, wherein said die second segment includes a contour comprising wrenching flats for forming on said pipe wrenching flats on said wrenching area.

12. The process of claim 11, comprising forming at least four wrenching flats on said outer surface of said outlet end portion.

13. The process of claim 10, comprising forming at least six wrenching flats on said outer surface of said outlet end portion.

14. The process of claim 9, comprising forming at least eight wrenching flats on said outer surface of said outlet end portion.

15. The process of claim 1, including positioning said pipe for engagement with the die, and applying said crimping force by applying mechanical or hydraulic pressure directed inwardly to compress the die inwardly toward the pipe.

16. The process of claim 1, wherein after forming said reduced diameter outlet end portion and said wrenching portion with said die, continuing holding of said pipe with said die, and carrying out secondary processes on said pipe to form said threading on said threaded outlet portion while holding said pipe with said die.

17. The process of claim 14, wherein said secondary processes include end finishing and reaming.

18. The process of claim 3, wherein said die comprises a plurality of pieces, including a first plurality of die pieces comprising said die first segment that corresponds with a surface of the outlet end portion, and a second plurality of die pieces comprising said die second segment that corresponds with a surface of the wrenching portion.

19. A process of manufacturing a reducing nipple, comprising:

providing a pipe having a channel extending therethrough;

providing a die having a first segment and a second segment, said die first segment setting a hole diameter of a threaded inner surface of an outlet end portion of the nipple, and said die second segment forming a wrenching area on said pipe comprising the wrenching area of said nipple;

forming a first reduced segment of said pipe to yield said outlet end portion of said nipple by engaging said pipe with said die first segment;

forming a second reduced segment of said pipe to yield said wrenching portion by engaging said pipe with said die second segment;

wherein forming said first reduced section comprises applying an inwardly directed crimping force to compress the first segment of the die inwardly toward the pipe to crimp the pipe inwardly with the first segment of the die resulting in the first reduced segment of said pipe having a channel extending through it that is narrower than the channel extending through the pipe when the pipe is initially provided; and wherein forming said second reduced section comprises applying an inwardly directed crimping force to compress the second segment of the die inwardly toward the pipe to crimp the pipe inwardly with the second segment of the die.

* * * * *